United States Patent [19]

Watson

[11] 4,258,235

[45] Mar. 24, 1981

[54] PRESSURE GRADIENT ELECTRET MICROPHONE

[75] Inventor: Alan R. Watson, Niles, Mich.

[73] Assignee: Electro-Voice, Incorporated, Buchanan, Mich.

[21] Appl. No.: 957,060

[22] Filed: Nov. 3, 1978

[51] Int. Cl.[3] ..... H04R 1/20; H04R 19/04

[52] U.S. Cl. ..... 179/121 D; 179/111 E

[58] Field of Search ..... 179/1 DM, 111 R, 111 E, 179/121 D

[56] References Cited

U.S. PATENT DOCUMENTS

| | | | |
|---|---|---|---|
| 2,579,162 | 12/1951 | Veneklasen | 179/111 R |
| 2,787,671 | 4/1957 | Grosskopf et al. | 179/121 D |
| 3,007,012 | 10/1961 | Olson | 179/111 R |
| 3,031,538 | 4/1962 | Gorike | 179/111 R |
| 3,201,530 | 8/1965 | Levy et al. | 179/121 D |
| 3,504,137 | 3/1970 | Ptackova et al. | 179/111 R |
| 3,940,575 | 2/1976 | Bauer | 179/121 D |
| 3,944,756 | 3/1976 | Lininger | 179/111 E |

FOREIGN PATENT DOCUMENTS

| | | | |
|---|---|---|---|
| 808593 | 7/1951 | Fed. Rep. of Germany | 179/111 R |
| 2558881 | 7/1976 | Fed. Rep. of Germany | 179/121 D |

*Primary Examiner*—Thomas W. Brown

*Attorney, Agent, or Firm*—Burmeister, York, Palmatier, Hamby & Jones

[57] ABSTRACT

A pressure gradient electret microphone provided with a plurality of channels extending between ports located in a ring of plastic material disposed about the periphery of a cylindrical back plate. Each of the channels expanding in horn fashion from the port at the diaphragm chamber to ports in the casing, and the ports in the casing being provided with an electrically conducting shield connected to the electrically conducting casing. In one embodiment of the invention, a line extends from the forward side of the diaphragm, and the line is provided with an aperture adjacent to the diaphragm coupling the diaphragm to the surrounding sound field at frequencies below the critical frequency of the line.

9 Claims, 4 Drawing Figures

PRESSURE GRADIENT ELECTRET MICROPHONE

The present invention relates to directional microphones, and particularly to condenser microphones using pressure gradients to provide directivity over at least a portion of the frequency response range of the microphone.

According to *Acoustical Engineering* by Harry F. Olson, D. Van Nostrand Company, Inc., Princeton, N.J., 1957, condenser microphones were developed in the mid 1920's and employed for sound reproduction. Thereafter, condenser microphones were replaced by other types of microphones until the 1950's. More recently, condenser microphones have been materially improved as a result of the development of the electret condenser unit, which eliminated the need for a power source and made it more convenient to construct microphones in smaller diameters. U.S. Pat. No. 3,944,756 to Thomas C. Lininger entitled ELECTRET MICROPHONE is an example of such a microphone.

Condenser microphones, whether of the electret or conventional type, employ a diaphragm constructed of metal or metal coated plastic film which is stretched across an opening in the housing of the microphone and spaced from a metal back plate or electrode by a diaphragm chamber. Pressure gradient condenser microphones employ a channel from the diaphragm chamber to a port located on the microphone casing spaced from the plane of the diaphragm. The sound entering the diaphragm chamber differs in phase from the sound striking the forward surface of the diaphragm due to the difference in the length of the path and the effect of the casing, and the deflection of the diaphragm is determined by the magnitude of the pressure differential between the diaphragm chamber and the forward side of the diaphragm. Such pressure gradient microphones are well known, one such microphone being described in *Microphones: Designs and Applications,* Lou Burroughs, Sagamore Publishing Company, Inc., 1974 at pages 54 through 58.

Pressure gradient microphones may be constructed as unidirectional microphones by providing for the cancellation of sound waves originating at the rear side of the diaphragm. It is an overall object of the present invention to improve the directionality of condenser pressure gradient directional microphones.

The inventor has found that a pressure gradient condenser microphone can be made more directional if a plurality of ports which communicate with the diaphragm chamber are provided. U.S. Pat. No. 2,921,993 to Beaverson entitled PRESSURE GRADIENT NOISE CANCELLING MICROPHONE discloses a noise cancelling microphone with spaced openings communicating with one or both sides of a diaphragm, the ports on the same side of the diaphragm being spaced by a distance approximately equal to a half wave length of a frequency which is to be discriminated against. It is an object of the present invention to provide a condenser pressure gradient microphone having a plurality of discrete and separate ports to the diaphragm chamber in which the ports are relatively close together.

It is a further object of the present invention to provide a pressure gradient condenser microphone in which the construction facilitates providing a diaphragm chamber of small volume, and in which the channels from the ports in the casing to the diaphragm chamber are of reduced volume.

Further, it is an object of the present invention to provide a combination line and pressure gradient microphone with a relatively short line and improved directional characteristics. The present invention is an improvement on the microphone described in U.S. Pat. No. 3,095,484 of Wayne A. Beaverson and Robert C. Ramsey entitled UNIDIRECTIONAL MICROPHONE in which a dynamic transducer is coupled to a line microphone and at low frequencies functions as a pressure gradient transducer.

It is a further object of the present invention to provide a pressure gradient electret condenser microphone which may readily be fabricated, and which is constructed to facilitate economical construction.

These and further objects of the present invention will readily be apparent to those skilled in the art from the following specification, particularly in the light of the drawings, in which.

Figure 1:
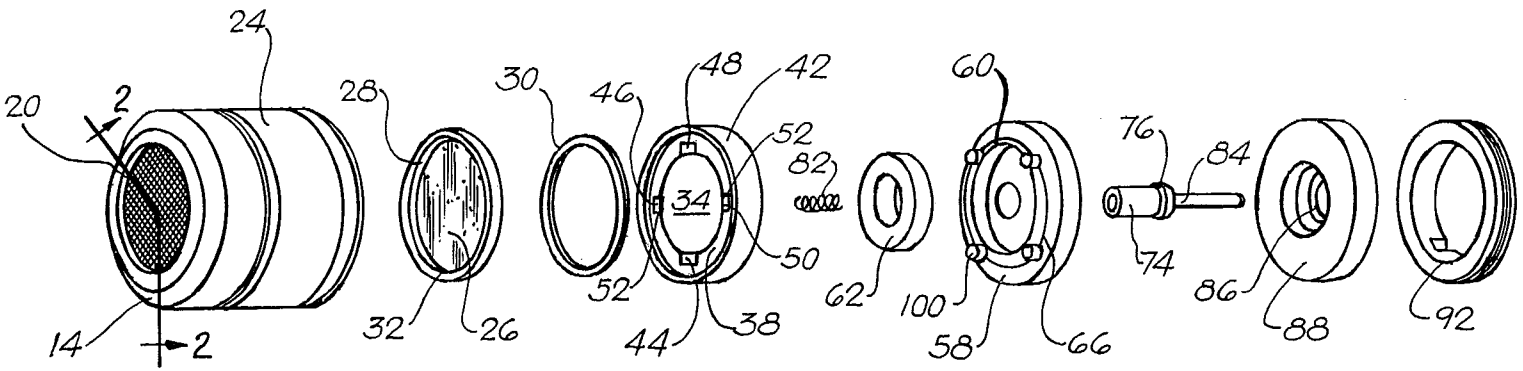
FIG. 1 is an exploded view of a microphone constructed according to the teachings of the present invention.
Figure 2:
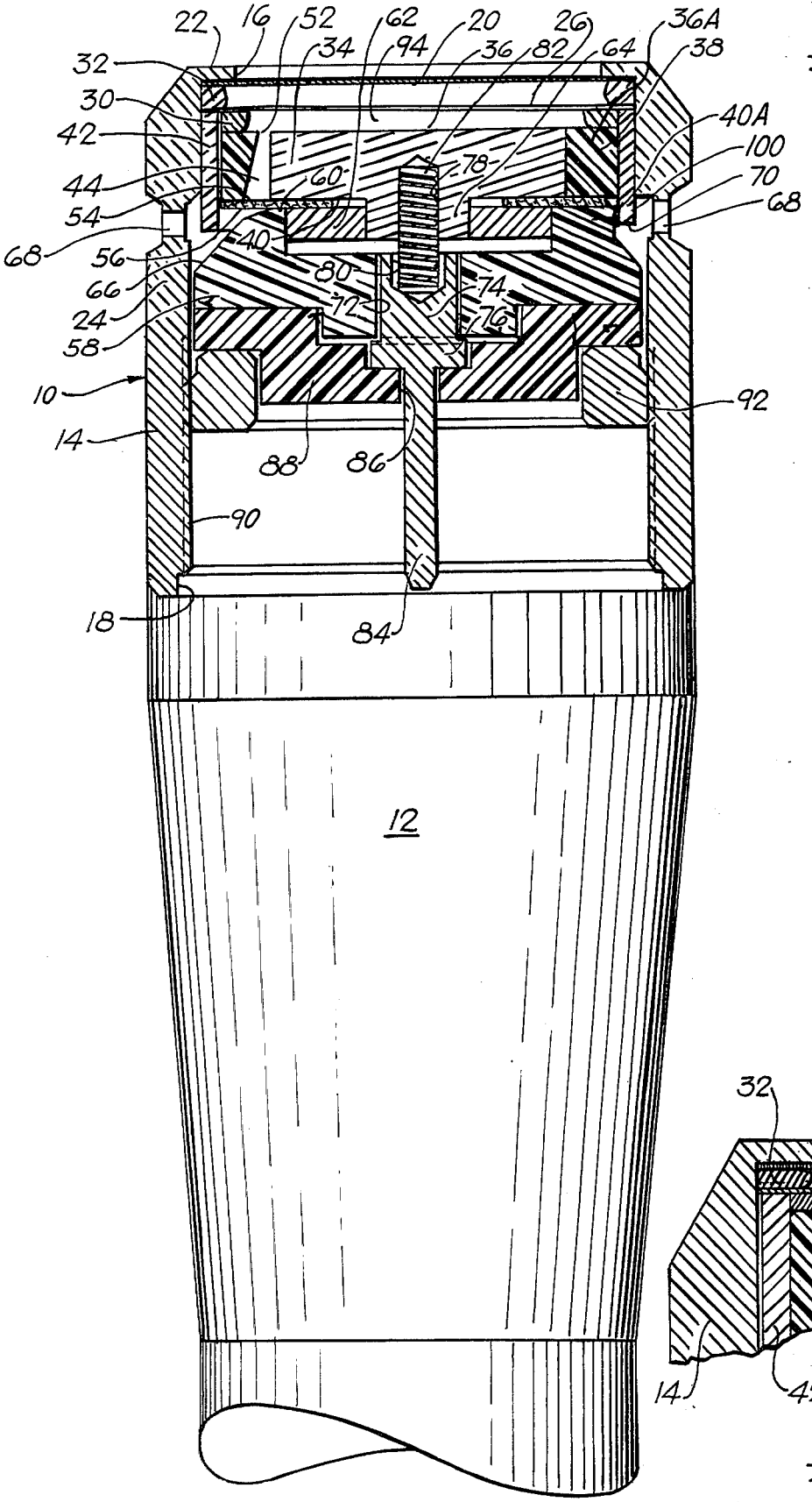
FIG. 2 is a transverse sectional view of the microphone taken along the line 2—2 of FIG. 1, the left portion being on a plane passing centrally between the posts of the dome member and the right portion being on a plane passing through one of the posts of the dome member.

FIG. 1 and FIG. 2 illustrate the capsule 10 which constitutes the microphone of the present invention. The capsule 10 is mounted on a handle 12 in the manner indicated by the inventor's co-pending application Ser. No. 903,809 entitled ELECTRET MICROPHONE, now U.S. Pat. No. 4,151,378. The capsule 10 has a casing 14 which is cylindrical in form and is provided with an opening 16 at one end and a second opening 18 on the end of the casing 14 mounted on the handle 12.

The opening 16 is circular in shape, and a screen 20 is disposed within the opening 16 and abuts at its periphery a lip 22 which protrudes inwardly from a cylindrical outer wall 24 of the casing. The screen 20 protects the interior of the casing 14 from foreign objects, and particularly protects a diaphragm 26 from injury. The diaphragm 26 is a portion of a sub-assembly 28 which includes circular spacers 30 and 32 which extend around the periphery of the diaphragm 26 on opposite sides thereof. The diaphragm 26 is constructed of electrically conducting material and is electrically connected to the casing 14 which is also constructed of electrically conducting material. The diaphragm 26 is a thin flexible and resilient layer which is disposed in a flat plane normal to the cylindrical axis of the casing 14.

An electrically conducting cylindrical back plate 34 is mounted within the casing 14 confronting the diaphragm 26. The back plate 34 has a flat circular surface 36 which is spaced from and disposed parallel to the diaphragm 26. The back plate 34 is sealed within a ring 38 of nonconducting material, such as plastic, and the ring 38 has a flat surface 36A which is an extension of the surface 36. In addition, the back plate 34 has a second flat surface 40 which extends inwardly from the periphery of the back plate, and the ring 38 is also provided with an extension of the surface 40 designated 40A. The surface 36A of the ring 38 abuts the spacer 30 of the diaphragm assembly 28, and the spacer 30 determines the distance between the diaphragm 26 and the surfaces 36 and 36A. A cylindrical sleeve 42 is disposed outwardly of the ring 38 and extends into abutment with the diaphragm assembly 28. The chamber formed between the diaphragm 26 and the surface 36 of the back plate 34 is acoustically sealed about it perimeter by the ring 38 and the spacer 30 of the diaphragm assembly.

The microphone is provided with four channels 44, 46, 48 and 50 which extend from ports 52 located at equal distances about the perimeter of the back plate 34. The ports 52 are rectangular in cross section and the channels leading from the ports 52 extend through the ring 38 to apertures 54 of rectangular cross section located in the surface 40A of the ring 38. The channels 44 46, 48 and 50 extend substantially perpendicularly to the surfaces 36 and 36A of the back plate 34 and ring 38. A layer 56 of cloth or other acoustical resistance material extends across each of the apertures 54, and is acoustically sealed on the surfaces 40 and 40A.

A circular dome member 58 is disposed within the casing 14 and has a circular edge 60 which extends into abutment with the surface 40 of the back plate 34. The edge 60, and a gasket 62 disposed between the edge 60 and a protuberance 64 extending outwardly on the cylindrical axis of the back plate 34 forms an acoustical seal between the dome member 58 and the back plate 34. The dome member 58 is provided with a tapering surface of revolution 66 which extends away from the surface 40A of the ring, thus forming an expanding horn structure from the aperture 54. The casing 14 is provided with a plurality of spaced ports 68 in the form of elongated slots. The ports 68 are spaced from the plane of the diaphragm 26 by the same distance and by a distance greater than the distance between the diaphragm 26 and the surface 40A. The sleeve 42 is constructed of electrically conducting material and electrically connected to the casing 14, and the end of the sleeve opposite the diaphragm, designated 70, extends to partially confront the ports 68 in the casing 14.

The dome member 58 is provided with an axial channel 72, and an electrically conducting pin 74 is disposed within the channel 72. The pin has a protruding hub 76 which abuts the dome member 58 about the channel to provide a space between the pin 74 and the hub 64 of the back plate 34. The back plate 34 and pin 74 are provided with aligned recesses 78 and 80, and a spiral electrically conducting spring 82 extends between the recesses 78 and 80 to provide electrical contact between the back plate 34 and the pin 74. The pin 74 is connected to a power source and audio amplifier located in the handle 12 of the microphone, not shown, as is well known.

The pin 74 has a portion of restricted diameter 84 which extends through an aperture 86 in a circular nonconducting member 88 disposed in abutment with the side of the dome member 58 opposite the back plate 34. The interior wall of the casing 14 is provided with threads 90, and a locking ring 92 engages the threads and compresses the nonconducting circular member 88 against the dome member 58. In like manner, the force exerted by the ring 92 is impressed against the back plate 34 and the diaphragm assembly, and secures these elements against the lip 22.

The microphone shown in FIGS. 1 and 2 is a pressure gradient microphone, that is, the diaphragm experiences a sound pressure which is the difference between the pressure exerted on the forward surface of the diaphragm and the pressure exerted in the cavity between the diaphragm and the back plate, this cavity being designated 94. Accordingly, the response of the microphone will be affected by any resonance which occurs in the path to the rear side of the diaphragm, and in most prior pressure gradient condenser microphones, the inertness of the outer case ports (the ports equivalent to the ports 68 of the preferred embodiment) and the cavity of such microphones between these rear ports in the outer case and the back plate results in resonances which affect the polar pattern of the microphone. In prior pressure gradient condenser microphones, the path to the rear side of the diaphragm has a substantial volume between the back plate and the casing which results in such resonances. In accordance with the present invention, three separate steps have been taken to avoid such resonances. First, the path to the rear side of the diaphragm includes a plurality of separate channels 44, 46, 48 and 50 which communicate with the back ports, each of these channels having its port 52 to the diaphragm cavity 94 at the periphery of the back plate, thereby minimizing the length of the channels. Second, each of the channels 44, 46, 48 and 50 is constructed as a horn in which the port 52 forms the throat of the horn, and the channel further constitutes a horn from the layer 56 of resistance material to the ports 68. In this way, the interior of the casing and the external port do not constitute a Helmholtz resonator. Third, each of the channels 44 46, 48 and 50 is acoustically isolated from all other channels in the region between the diaphragm cavity 94 and the aperture 54. The gasket 62 is cemented on the surface 40 of the back plate 34 to provide an acoustical seal between the channels 44 46, 48 and 50.

It will be recognized that this construction makes possible a pressure gradient microphone with a short distance between the plane of the diaphragm and the openings in the casing to the rear of the diaphragm. The use of a multiple of channels 44 46, 48 and 50 to the diaphragm chamber 94 and the use of a short distance between the ports 68 and the plane of the diaphragm 26 is effective to maximize directivity of this microphone.

Figure 3:
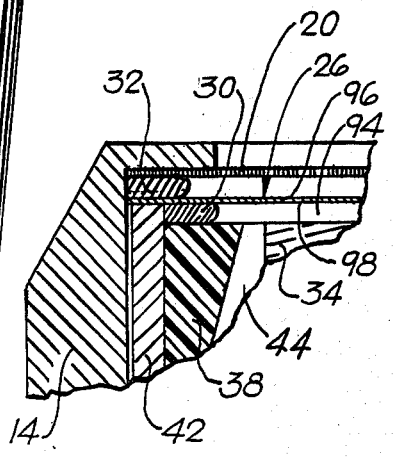
FIG. 3 is a fragmentary sectional view taken in the plane of FIG. 2.

As illustrated in FIG. 3, the diaphragm 26 is a thin film 96 of electrically insulating plastic with a coating 98 of electrically conducting material confronting the back plate 34. In one particular construction, the film 96 is constructed of Teflon and the coating 98 is silver. The diaphragm has a diameter of approximately $\frac{3}{4}$ inch and the forward edges of the ports 68 are disposed at a distance of approximately 0.3 inch from the plane of the diaphragm. The diaphragm is electrically charged with respect to the back plate 34, and the microphone operates in the manner of an electret microphone.

It will be noted that the ring 38 is constructed of electrically insulating material, and may be plastic. As a result of the use of relatively soft and easily worked plastic, the channels 44 46, 48 and 50 may readily be formed in the ring 38 and controlled as to size. Likewise, the dome member 58 may be constructed of plastic and readily shaped to the desired shape. It will be noted that the dome member is provided with four spaced posts 100 which abut the surface 40A of ring 38 and assure proper positioning of the dome member 58. The sleeve 42 is constructed of electrically conducting material, such as aluminum, and provides a hum shield for the ports 68.

Figure 4:
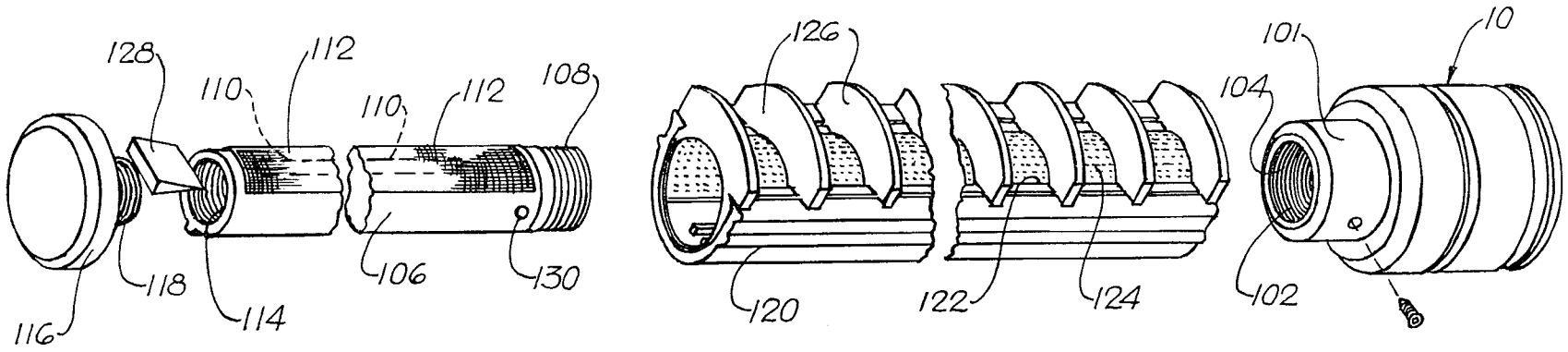
FIG. 4 is an exploded view of a line microphone which constitutes another embodiment of the present invention.

FIG. 4 illustrates the present invention employed in a line microphone. The same identical condenser capsule 10 described in FIGS. 1 through 3 is provided with an outwardly extending cylindrical collar 101 which is disposed about the opening 16 in the casing 14 and is provided with a central cylindrical passage 102 carrying threads 104 at its inner surface. A tube 106 is provided with threads 108 on its outer surface at one end, and the tube is positioned within the collar 101 with the threads 108 engaging the threads 102. The tube is provided with a plurality of slots 110 along its axial length, and a layer of cloth 112 of resistance material is disposed over the slots 110. The end of the tube 106 opposite the condenser capsule 10 has threads on its inner surface designated 114, and a plug 116 having a threaded portion 118 is mounted within this end of the tube 106 with the threads 114 engaging the threads 118.

A hollow sleeve 120 is disposed about the tube 106, and the sleeve 120 has an elongated slot 122 which is aligned with the slots 110 and the tube 106. A sound porous screen 124 is mounted in the slot 122 for purposes of keeping foreign matter from the line, and a plurality of spaced baffles 126 are disposed along the length of the sleeve 120. A wedge 128 is mounted between the tube 106 and the screen 124 of the sleeve 120 to provide spacing between the sleeve 120 and the tube 106.

The length of the tube 106 is selected to have a cutoff frequency of about 1,000 Hz., thus making the tube significantly shorter than necessary in a microphone to be operated as a line microphone throughout all frequencies. For frequencies below 1,000 Hz., the microphone acts as a pressure gradient microphone, that is, it responds to the difference in sound pressure on the diaphragm 26 between the diaphragm chamber 94 and the forward side of the diaphragm. At frequencies above 1,000 Hz., the inertness of the ports 68 substantially closes these ports, and the microphone functions as a line microphone. The length of the line (slotted tube 106) is 13½ inches long in a preferred embodiment of the present invention.

Prior line microphones which utilize a pressure gradient transducing element to achieve low frequency directivity have exhibited exaggerated bass response at frequencies below the critical frequency and poor directivity at low frequencies. For this reason, a port 130 is provided in the tube 106 adjacent to the threaded end 108 in order to permit the sound field to have direct access to the forward side of the diaphragm for frequencies below the critical frequency, that is, the frequency at which the line loses its directivity. The port 130 is inertive, and hence it is essentially nonexistent at higher frequencies. At low frequencies, it is sufficiently open that it acoustically decouples the line from the forward side of the diaphragm 26, thus permitting the pressure gradient capsule 10 to achieve mid band directivity and to reduce exaggerated bass response. At mid frequencies and lower frequencies, the microphone of FIG. 4 achieves substantially the response and characteristics of the embodiment of FIGS. 1 through 3 and functions in an analogous manner.

Those skilled in the art will recognize many advantages to the present invention over those set forth herein, and will devise applications of the present invention in addition to those here described. It is therefore intended that the scope of the present invention be not limited by the foregoing specification, but rather only by the appended claims.

The invention claimed is:

1. A directional condenser microphone comprising a hollow casing having an opening extending from the exterior to the interior thereof, an electrically conducting diaphragm disposed in a flat plane confronting the opening in the casing, means for mounting said diaphragm on the casing and acoustically sealing the diaphragm about the perimeter of the opening, an electrically conducting back plate mounted in the casing and electrically insulated from the diaphragm, said back plate having a flat surface disposed parallel to and confronting the side of the diaphragm opposite the opening, means including the back plate and diaphragm forming a cavity between the diaphragm and back plate, and channel defining means including the cavity forming means and casing defining a plurality of channels, each of said channels having a first port at one end and a second port at the other end, the first port of each channel communicating with the cavity and being located adjacent to the perimeter of the back plate, and the first ports of the plurality of channels being spaced from each other, the portion of each of said channels adjacent to the first port being acoustically isolated from each other, the second port of each channel being located on the exterior of the casing, said second ports being spaced from the plane of the diaphragm by approximately the same distance, said cavity being acoustically coupled to the sound field exterior of the casing only through the diaphragm and the channels.

2. A directional condenser microphone comprising the combination of claim 1 wherein the first port of each of the channels is in the plane of the flat surface of the back plate, the isolated portions of each of the channels increasing in cross sectional area from the first port to form an acoustical horn.

3. A directional condenser microphone comprising the combination of claim 2 wherein each of the channels is provided with an aperture between the first port and the second port, the channels being isolated from each other between the first port thereof and the aperture thereof, in combination with means defining a second acoustical horn disposed within the casing between the apertures of the channels and the second port, said horn having a throat disposed at the apertures.

4. A directional condenser microphone comprising the combination of claim 3 in combination with a mass of acoustical resistance material disposed in each of the channels at the aperture thereof.

5. A directional condenser microphone comprising the combination of claim 2 wherein the back plate is cylindrical with the flat surface disposed on one end thereof, and the means forming a cavity between the diaphragm and the back plate includes a ring of electrically insulating material sealed about the back plate and forming an extension of the flat surface of the back plate, a portion of each of the channels being disposed in the ring with the first port of each channel in the portion of the ring forming an extension of the flat surface of the back plate.

6. A directional condenser microphone comprising the combination of claim 5 wherein the back plate has a second flat surface parallel to the first flat surface on the side thereof opposite the first flat surface and extending inwardly from the periphery thereof, and the ring of electrically insulating material has a second flat surface forming an extension of the second flat surface of the back plate, each of the channels extending through an aperture in the second flat surface of the ring, in combination with a mass of acoustical resistance material extending over the aperture and sealed thereabout, the second ports being disposed on the casing adjacent to the plane of the second flat surface of the back plate.

7. A directional condenser microphone comprising the combination of claim 6 in combination with a dome member disposed in abutment with the second surface of the back plate and extending to the casing, said dome member having a surface of revolution extending from the perimeter of the back plate away from the second surface of the ring to form a horn from the second ports to each of the apertures in the ring.

8. A directional microphone comprising the combination of claim 7 wherein the dome member is constructed of electrically insulating material and the casing comprises electrically conducting material, in combination with an electrically conducting sleeve electrically connected to the casing, said sleeve being disposed about the ring and extending from the second surface of the ring toward the dome member.

9. A directional condenser microphone comprising the combination of claim 1 in combination with an elongated line having a cutoff frequency substantially above the low frequency limit of the response range of the microphone, said line comprising a hollow tube constructed of sound impermeable material mounted on the casing at one end about the opening therein, said tube having openings along the length of the tube for admitting sound into the tube to the diaphragm, a mass of acoustical resistance material disposed on said openings in the tube, said tube being provided with a port located in the tube adjacent to the diaphragm, said port being inertive and forming a low pass filter admitting the sound field about the microphone into the tube at frequencies below the cutoff frequency of the line.

* * * * *